US007042404B2

(12) United States Patent
Jo et al.

(10) Patent No.: US 7,042,404 B2
(45) Date of Patent: May 9, 2006

(54) APPARATUS FOR REDUCING GROUND EFFECTS IN A FOLDER-TYPE COMMUNICATIONS HANDSET DEVICE

(75) Inventors: Young-Min Jo, Rockledge, FL (US); Myung-Sung Lee, Seoul (KR); Joo-Sik Lee, Seoul (KR); Won-Suk Jeong, Seoul (KR); Yong-Gil Park, Gyeonggi-do (KR); Jeong Kim, Gyeonggi-do (KR)

(73) Assignee: SkyCross, Inc., Melbourne, FL (US)

( * ) Notice: Subject to any disclaimer, the term of this patent is extended or adjusted under 35 U.S.C. 154(b) by 17 days.

(21) Appl. No.: 10/875,850

(22) Filed: Jun. 24, 2004

(65) Prior Publication Data

US 2005/0007283 A1 Jan. 13, 2005

Related U.S. Application Data

(60) Provisional application No. 60/486,585, filed on Jul. 11, 2003.

(51) Int. Cl.
*H01Q 1/24* (2006.01)

(52) U.S. Cl. ..... 343/702

(58) Field of Classification Search ..... 343/702, 343/700 MS, 846, 741, 742, 744, 895
See application file for complete search history.

(56) References Cited

U.S. PATENT DOCUMENTS 6,573,869 B1 * 6/2003 Moore ..... 343/702
6,590,543 B1 * 7/2003 Apostolos ..... 343/742
6,653,987 B1 * 11/2003 Lamensdorf et al. ..... 343/895
6,819,287 B1 * 11/2004 Sullivan et al. ..... 343/700 MS

OTHER PUBLICATIONS

Harvey, A. F.; "Periodic and Guiding Structures at Microwave Frequencies"; IRE Transactions on Microwave Theory and Techniques; Jan. 1960; pp. 30-61.

* cited by examiner

*Primary Examiner*—Trinh V. Dinh
*Assistant Examiner*—Huedung X. Cao
(74) *Attorney, Agent, or Firm*—John L. DeAngelis, Jr.; Beusse Wolter Sanks Mora & Maire, P.A.

(57) ABSTRACT

An antenna for a folder type communications handset. The handset comprises first and second enclosures pivotably joined to permit rotation of one enclosure relative to the other enclosure. The antenna is disposed over a ground plane formed in a printed circuit board in the first enclosure. The second enclosure also comprises a ground plane. A feed terminal and a ground terminal of the antenna are disposed to limit field coupling between the feed terminal and the ground plane in the second enclosure. The feed and the ground terminals are each connected to corresponding terminals on the printed circuit board by meanderline conductors.

18 Claims, 4 Drawing Sheets

APPARATUS FOR REDUCING GROUND EFFECTS IN A FOLDER-TYPE COMMUNICATIONS HANDSET DEVICE

This application claims priority to the provisional patent application filed on Jul. 11, 2003, assigned application Ser. No. 60/486,585 and entitled Apparatus for Reducing Ground Effects in a Folder-Type Communications Handset Device.

FIELD OF THE INVENTION

The present invention relates generally to antennas for portable communications devices and more specifically to an antenna for limiting ground plane effects on the radiation characteristics of a folder-type communications handset.

BACKGROUND OF THE INVENTION

It is generally known that antenna performance is dependent upon the size, shape, separation distance and material composition of the constituent antenna elements, as well as the relationship between certain antenna physical parameters (e.g., length for a linear antenna and diameter for a loop antenna) and the wavelength of the signal received or transmitted by the antenna. These parameters and relationships determine several antenna operational characteristics, including input impedance, gain, directivity, signal polarization, operating frequency, bandwidth and radiation pattern. Generally for an operable antenna, the minimum physical antenna dimension (or the electrically effective minimum dimension) must be on the order of a half wavelength (or a multiple thereof) of the operating frequency, which thereby advantageously limits the energy dissipated in resistive losses and maximizes the transmitted energy. Half-wavelength antennas and quarter-wavelength antennas over a ground plane (which effectively perform as half-wavelength antennas) are the most commonly used.

The burgeoning growth of wireless communications devices and systems has created a substantial need for physically smaller, less obtrusive, and more efficient antennas that are capable of wide bandwidth operation, multiple frequency-band operation, and/or operation in multiple modes (i.e., selectable radiation patterns or selectable signal polarizations). Smaller packaging for state-of-the-art communications devices, such as cellular telephone handsets and other portable devices, does not provide sufficient space for the conventional quarter and half-wavelength antenna elements. Thus physically smaller antennas operating in the frequency bands of interest and providing other desired antenna-operating properties (input impedance, radiation pattern, signal polarizations, etc.) are especially sought after. Ideally, such antennas are disposed within the handset case so as to avoid possible damage to or breakage of an externally mounted antenna.

Half-wavelength and quarter-wavelength dipole antennas are popular externally mounted handset antennas. Both antennas exhibit an omnidirectional radiation pattern (i.e., the familiar omnidirectional donut shape) with most of the energy radiated uniformly in the azimuth direction and little radiation in the elevation direction. Frequency bands of interest for certain portable communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical antenna gain is about 2.15 dBi. Antennas of this length may not be suitable for most handset applications.

The quarter-wavelength monopole antenna disposed above a ground plane is derived from a half-wavelength dipole. The physical antenna length is a quarter-wavelength, but when placed above a ground plane the antenna performs as a half-wavelength dipole. Thus, the radiation pattern for a quarter-wavelength monopole antenna above a ground plane is similar to the half-wavelength dipole pattern, with a typical gain of approximately 2 dBi.

Several different antenna types can be embedded within a communications handset device. Generally, it is desired that these antennas exhibit a low profile so as to fit within the available space envelope of the handset package. Antennas protruding from the handset case are prone to damage by breaking or bending.

A loop antenna is one example of an antenna that can be embedded in a handset. The common free space (i.e., not above ground plane) loop antenna (with a diameter approximately one-third of the signal wavelength) displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics.

Antenna structures comprising planar radiating and/or feed elements can also be employed as embedded antennas. One such antenna is a hula-hoop antenna, also known as a transmission line antenna (i.e., a conductive element over a ground plane). The loop is essentially inductive and therefore the antenna includes a capacitor connected between a ground plane and one end of the hula-hoop conductor to create a resonant structure. The other end serves as the antenna feed terminal.

Printed or microstrip antennas are constructed using patterning and etching techniques employed in the fabrication of printed circuit boards. These antennas are popular because of their low profile, the ease with which they can be formed and their relatively low fabrication cost. Typically, a patterned metallization layer on a dielectric substrate operates as the radiating element.

A patch antenna, one example of a printed antenna, comprises a dielectric substrate overlying a ground plane, with the radiating element overlying the top substrate surface. The patch antenna provides directional hemispherical coverage with a gain of approximately 3 dBi.

Another type of printed or microstrip antenna comprises a spiral and sinuous antennas having a conductive element in a desired shape formed on one face of a dielectric substrate. A ground plane is disposed on the opposing face.

Another example of an antenna suitable for embedding in a handset device is a dual loop or dual spiral antenna described and claimed in the commonly owned U.S. Pat. No. 6,856,286 entitled Dual Band Spiral-shaped Antenna. The antenna offers multiple frequency band and/or wide bandwidth operation, exhibits a relatively high radiation efficiency and gain, along with a low profile and relatively low fabrication cost.

As shown in FIG. 1, a spiral antenna 8 comprises a radiating element 10 over a ground plane 12. The ground plane 12 comprises an upper and a lower conductive material surface separated by a dielectric substrate, or in another embodiment comprises a single sheet of conductive material disposed on a dielectric substrate. The radiating element 10 is disposed substantially parallel to and a spaced apart from the ground plane 12, with a dielectric gap 13 (comprising, for example, air other known dielectric materials) therebetween. In one embodiment the distance between the ground plane 12 and the radiating element 10 is about 5 mm An antenna constructed according to FIG. 1 is suitably sized for insertion in a typical handset communications device.

A feed pin 14 and a ground pin 15 are also illustrated in FIG. 1. One end of the feed pin 14 is electrically connected to the radiating element 10. An opposing end is electrically connected to a feed trace 18 extending to an edge 20 of the ground plane 12. A connector (not shown in FIG. 1), is connected to the feed trace 18 for providing a signal to the antenna 8 in the transmitting mode and responsive to a signal from the antenna 8 in the receiving mode. As is known, the feed trace 18 is insulated from the conductive surface of the ground plane 12, although this feature is not specifically shown in FIG. 1. The feed trace 18 is formed from the conductive material of the ground plane 12 by removing a region of the conductive material surrounding the feed trace 18, thus insulating the feed trace 18 from the ground plane 12.

The ground pin 15 is connected between the radiating element 10 and the ground plane 12. In different embodiments the feed pin 14 and the ground pin 15 are formed from hollow or solid conductive rods, such as hollow or solid copper rods.

As illustrated in the detailed view of FIG. 2, the radiating element 10 comprises two coupled and continuous loop conductors (also referred to as spirals or spiral segments) 24 and 26 disposed on a dielectric substrate 28. The outer loop 24 is the primary radiating region and exercises primary influence over the antenna resonant frequency. The inner loop 26 primarily affects the antenna gain and bandwidth. However, it is known that there is significant electrical interaction between the outer loop 24 and the inner loop 26. Thus it may be a technical oversimplification to indicate that one or the other is primarily responsible for determining an antenna parameter as the interrelationship can be complex. Also, although the radiator 10 is described as comprising an outer loop 24 and an inner loop 26, there is not an absolute line of demarcation between these two elements.

BRIEF SUMMARY OF THE INVENTION

The invention comprises a communications device operative to transmit and receive communications signals, comprising first and second enclosures coupled by a pivotable joint joining the first and the second enclosures along an edge of each of the first and the second enclosures, wherein the first and the second enclosures further comprise respective first and second surfaces, and wherein the communications device is in a closed state when the first and the second surfaces are disposed in a proximate facing relation, and wherein the communications device is in a open state when the first and the second surfaces are disposed in a spaced apart relation by pivoting of the first and the second enclosures with respect to the pivotable joint. The communications device comprises within the first enclosure, a radio frequency signal radiating element comprising a first feed terminal and a first ground terminal, and a first substrate spaced apart from the radiating element and comprising a ground plane having a second ground terminal, the substrate further comprising a second feed terminal. The first enclosure further comprises a first conductive element connected between the first and the second feed terminals and a second conductive element connected between the first and the second ground terminals. A second ground plane is enclosed within the second enclosure. At least one of the first feed terminal and the first ground terminal are positioned on the radiating element to minimize coupling between the radiating element and the second ground plane when the communications device is the open state.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
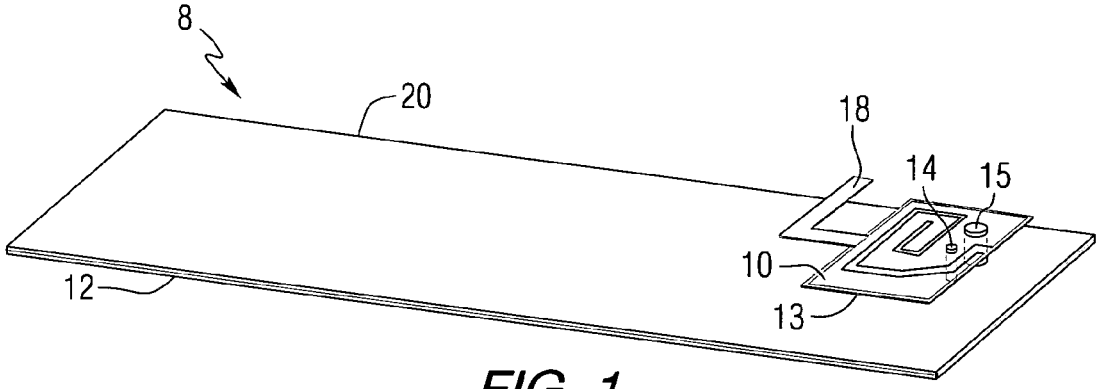
FIG. 1 PRIOR ART
FIGS. 1 and 2 are perspective views of an antenna suitable for use in a handset communications device according to the teachings of the present invention.

Before describing in detail the particular antenna and communications apparatus of the present invention, it should be observed that the present invention resides primarily in a novel and non-obvious combination of elements. Accordingly, the inventive elements have been represented by conventional elements in the drawings, showing only those specific details that are pertinent to the present invention so as not to obscure the disclosure with structural details that will be readily apparent to those skilled in the art having the benefit of the description herein.

Figure 2:
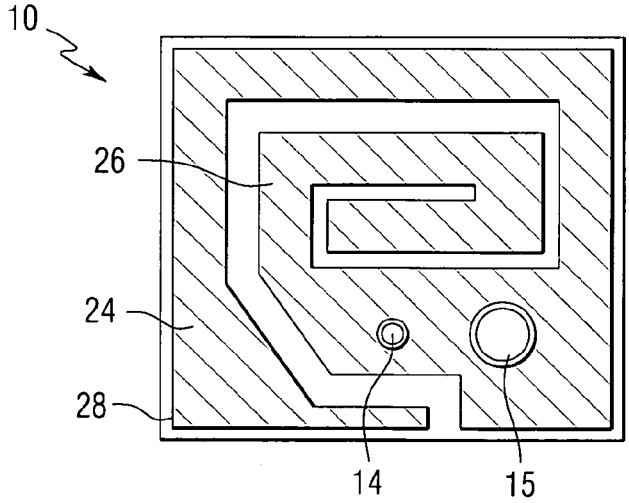
FIG. 2 PRIOR ART
Figure 3:
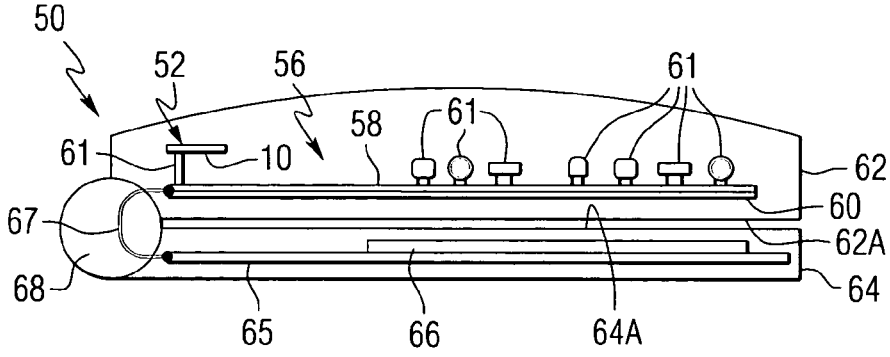
FIG. 3 illustrates an exemplary handset device in a closed position.

FIG. 3 illustrates a so-called folder type communications handset device 50 (a typical cellular telephone handset style) including an embedded antenna 52. In one example the embedded antenna 52 comprises the spiral antenna 8, further comprising the radiating element 10 physically and electrically attached to a printed circuit board 56 further comprising a ground plane 58 and a dielectric substrate 60. Conventionally the ground plane 58 comprises a conductive region disposed on a portion of the printed circuit board 56, with electronic components 61 and interconnecting conductive traces (not shown) disposed on other regions of the printed circuit board 56. The feed pin 14 (see FIGS. 1 and 2) is electrically connected between the radiating element 10 and a feed trace (not shown) on the printed circuit board 56, wherein the feed trace can be connected to one or more of the electronic components and interconnecting conductive traces. The ground pin 15 (see FIGS. 1 and 2) is connected between the radiating element 10 and the ground plane 58. The feed pin 14 and the ground pin 15 are generally represented in FIG. 3 by an element 61, which extends from the circuit board 56 to the radiating element 10. Note that since the feed pin 14 and the ground pin 15 are laterally adjacent in the embodiment of FIG. 1, one is obscured in the side view of FIG. 3.

The radiating element 10 operates in conjunction with the ground plane 58 as in the exemplary antennas described above, causing the embedded antenna 52 to emit radio frequency energy when the handset 50 is operative in a transmitting mode and to receive radio frequency energy when the handset 50 is operative in a receiving mode. The antenna 52 as illustrated herein is intended to include any of the various antenna designs that can be embedded in the handset 50, including those described above and others known in the art (e.g., an inverted F antenna or a PIFA antenna).

The handset 50 further comprises a lower case or lower folder 62 enclosing the embedded antenna 52 and the printed circuit board 56, and an upper case or upper folder 64 comprising a ground plane 65, an LCD (liquid crystal display) 66 and other elements as known in the art operative in conjunction with the handset 50. The ground planes 58 and 65 are connected by a flexible cable 67 passing through a suitable opening in each of the upper and lower folders 62 and 64. The lower folder 62 further comprises a surface 62A and the upper folder 64 further comprises a surface 64A as shown.

In a closed state or closed position illustrated in FIG. 3 the surface 62A is proximately spaced-apart from and generally parallel to the surface 64A. The lower and upper folders 62 and 64 are mechanically coupled by a rotatable or pivotable joint 68, permitting the upper folder 64 to be pivoted with respect to the lower folder 62 into an operational (or open) position as illustrated in FIG. 4 where the surface 62A is spaced away from the surface 64A.

Figure 4:
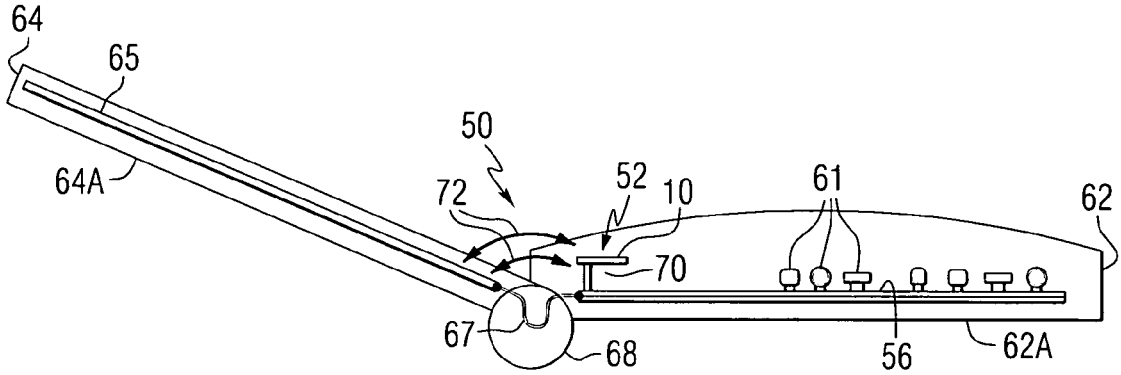
FIG. 4 illustrates an exemplary handset device in an opened position.

Continuing with the description of FIG. 4, for the embedded antenna 52, a maximum current region 70 is present at a location where the current feeds the radiating element 10, e.g., where the feed pin 14 is in conductive communication with the radiating element 10. Due to substantial current flow in the region 70, when the handset device 50 is in the open or operational position of FIG. 4 there is considerable electric field coupling between the ground plane 65 of the upper folder 64 and the radiating element 10. The coupling, indicated by field lines 72, detunes the operational frequency of the embedded antenna 52 and can affect other operational antenna parameters. Generally, the embedded antenna 52 is designed to operate in conjunction with the ground plane 58. However, when configured to the opened position of FIG. 4, the ground plane 65 is also coupled to the antenna 52, causing the aforementioned detuning effects.

For example it has been demonstrated that with the handset 50 in the closed position (as in FIG. 3) the antenna 52 exhibits a resonant frequency peak at about 875 MHz. When the handset 50 is configured in the open position (as in FIG. 4), the resonant frequency peak shifts (i.e., the antenna is detuned) to about 825 MHz. Accordingly, the coupling between the radiating element 10 and the ground plane 65 shifts the antenna operative frequency by about 50 MHz. Such a considerable frequency shift can significantly degrade performance of the handset 50.

Note the coupling effect is absent when the lower and upper folders 62 and 64 are in the closed orientation, since the ground plane 58 is interposed between and thus blocks the effects of the ground plane 65 on the radiating element 10. Of course, the handset 50 is not designed for operation in the closed position.

According to the teachings of the present invention, the region of substantial current flow is relocated away from the ground plane 65 when the handset 50 is in the open position to reduce coupling between the antenna 52 and the ground plane 65. Thus, when the handset 50 is opened for operation the antenna performance characteristics will not be substantially altered. To reduce the coupling, one or both of the feed and ground terminals on the prior art radiating element 10 is relocated to minimimze coupling between the radiating element and the ground plane 65 when the handset 50 is in the open state. The extent to which the coupling is minimized according to the teachings of the present invention is dependent on the physical construction and separation distances of the various elements of the handset 50.

It is generally considered advantageous to retain the location of the feed and ground terminals on the printed circuit board 56 (to which the feed and ground terminals of the radiating element are connected) such that an antenna constructed according to the teachings of the present invention constitutes a pin-for-pin replacement for a prior art antenna that exhibits the frequency detuning effects described above. Further, the coupling effect that causes antenna detuning is not substantially affected by the location of the feed and ground terminals on the printed circuit board 56.

Figure 5:
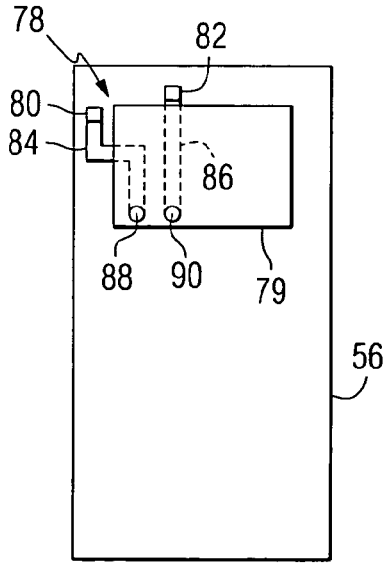
FIGS. 5 and 6 illustrate an antenna constructed according to the teachings of the present invention.
Figure 6:
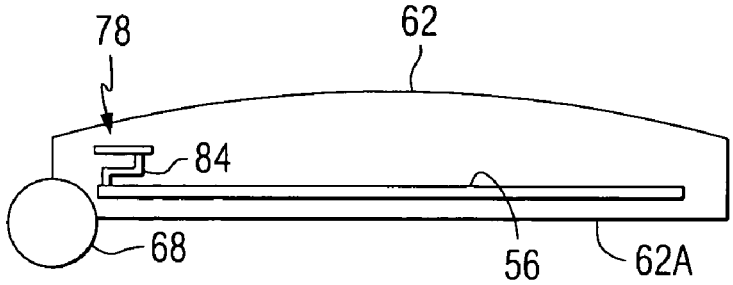

As illustrated in the top view of FIG. 5, the printed circuit board 56 comprises a feed terminal 80 and a ground terminal 82, which are shown in exemplary locations on the printed circuit board 56. An antenna 78 constructed according to the teachings of the present invention, as illustrated in both the top view of FIG. 5 and the side view of FIG. 6, comprises conductors 84 and 86 connected between the feed and ground terminals 80 and 82 on the printed circuit board 56, and feed and ground terminals 88 and 90 on a radiating element 79 of the antenna 78. Preferably, the conductors comprise meanderline conductors, 84 and 86. Meanderline conductors are generally defined as conductive structures disposed over a ground plane with a separating dielectric material therebetween, where the conductor's electrical length may not be equal to its physical length. Thus in the embodiment of FIGS. 5 and 6, the meanderline conductors 84 and 86 are suspended between the radiating element 79 and the printed circuit board 56, as illustrated in the side view of FIG. 6, such that there is an underlying ground plane (i.e., the ground plane 58) and a dielectric material between the conductor structures and the ground plane (i.e., an air gap dielectric). Use of a dielectric material other than air increases the effective electrical length of the meanderline conductors compared to the effective electrical length with an air dielectric. Thus the physical length of each one of the meanderline conductors 84 and 86 can be made shorter when a dielectric material other than air is employed, yet the meanderline conductors 84 and 86 will exhibit the appropriate electrical length relative to the wavelength of the signal transmitted or received by the antenna 78.

The meanderline conductors 84 and 86 are so-called slow wave structures where the physical dimensions of the conductor are not equal to its effective electrical dimensions. Generally, a slow-wave conductor or structure is defined as one in which the phase velocity of the traveling wave is less than the free space velocity of light. The phase velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light in a vacuum (c), the wavelength of the wave in the structure is lower than the free space wavelength. Thus, for example, a half-wavelength slow wave structure is shorter than a half-wavelength conventional structure in which the wave propagates at the speed of light. The slow-wave structure de-couples the conventional relationships among physical length, resonant frequency and wavelength, permitting use of a physically shorter conductor since the wavelength of the wave traveling in the conductor is reduced from its free space wavelength.

Slow wave structures are discussed extensively by A. F. Harvey in his paper entitled *Periodic and Guiding Structures*

*at Microwave Frequencies*, in the IRE Transactions on Microwave Theory and Techniques, Jan. 1960, pp. 30–61 and in the book entitled *Electromagnetic Slow Wave Systems* by R. M. Bevensee published by John Wiley and Sons, copyright 1964. Both of these references are incorporated by reference herein.

A transmission line or conductive surface overlying a dielectric substrate exhibits slow-wave characteristics, such that the effective electrical length of the slow-wave structure is greater than its actual physical length according to the equation, $$l_e=(\epsilon_{eff}^{1/2})\times l_p.$$

where $l_e$ is the effective electrical length, $l_p$ is the actual physical length, and $\epsilon_{eff}$ is the dielectric constant ($\epsilon_r$) of the dielectric material proximate the transmission line.

The meanderline conductors 84 and 86 should also exhibit appropriate impedance matching characteristics and present the required electrical length for producing the desired characteristics for the antenna 78. Additionally, in one embodiment the length of the meanderline conductor 84 (which connects the feed terminal 80 on the printed circuit board 56 to the feed terminal 88 on the radiating element 79) may have to be shorter than about $\lambda/8$, where $\lambda$ represents the wavelength of the signal carried by the meanderline conductor 84. If longer than $\lambda/8$, the meanderline conductor 84 can disadvantageously act as radiating structure, causing significant energy coupling with the radiating element 79 and thereby reducing the efficiency (gain) of the antenna 78.

Figure 7:
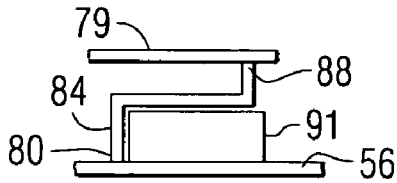
FIGS. 7–9 illustrate antennas constructed according to other embodiments of the present invention.

In another embodiment, the meanderline conductors 84 and 86 are supported by an underlying dielectric substrate 91 as illustrated in the partial side view of FIG. 7. Use of the dielectric substrate 91 allows for physically shorter meanderline conductors 84 and 86 (because the dielectric constant of the substrate 91 is greater than the dielectric constant of air) and also promotes repeatability during the manufacturing process to ensure proper physical placement of the meanderline conductors 84 and 86.

Figure 8:
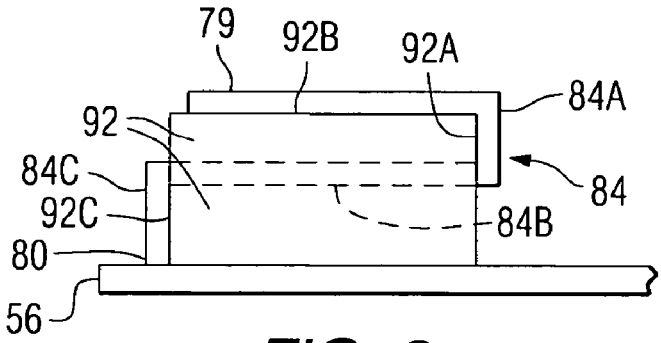

In yet another embodiment, the meanderline conductors 84 and 86 are formed within and on one or more surfaces of a dielectric substrate or carrier 92 that substantially fills the region between the radiating element 79 and the printed circuit board 56. See FIG. 8 where only the meanderline conductor 84 is illustrated as the meanderline conductor 86 is hidden from view. Segments 84A and 84C of the meanderline conductor 84 are disposed on surfaces 92A and 92C of the dielectric substrate 92. The segment 84C is connected to the feed terminal 80 on the printed circuit board 56. A segment 84B is disposed internal the dielectric substrate 92. The radiating element 79 is disposed on a surface 92B. The dielectric substrate 92 and the conductive elements can be formed according to known masking and subtractive etching techniques such as those used to form conductive patterns on single-layer and multi-layer printed circuit boards. The embodiment of FIG. 8 further promotes repeatable manufacturing and accurate placement of the meanderline conductors 84 and 86 and the radiating element 79.

Figure 9:
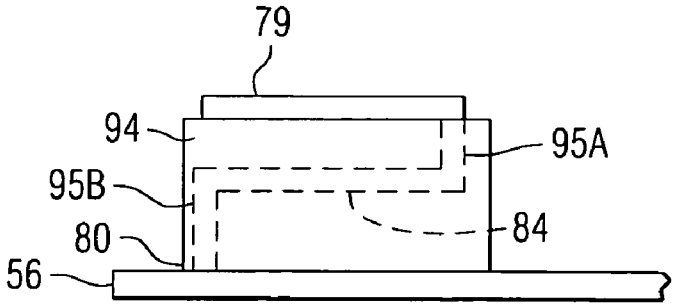

In still another embodiment illustrated in FIG. 9, a dielectric substrate 94 comprises two conductive vias 95A and 95B with the meanderline conductor 84 connected therebetween. The conductive via 95A is further connected to the radiating element 79 and the conductive via 95B is further connected to the feed terminal 80 on the printed circuit board 56.

Use of meanderline structures for the meanderline conductors 84 and 86 can advantageously reduce the size of the antenna 78, as a meanderline structure exhibits electrical dimensions that are greater that its physical dimensions, as discussed above.

Since the location of the feed terminal 88 on the radiating element 79 (a region of relatively high current) in FIG. 5 is farther from the ground plane 65 (when the handset 50 is disposed in the opened position) than the embodiment of FIG. 4, the coupling between the radiating element 79 and the ground plane 65 is reduced, especially in the high current region 70 of FIG. 4. With reduced coupling, the ground plane detuning effects created by the ground plane 65 are reduced. In one embodiment the frequency shift is reduced from the 50 MHz referred to above to about 10–20 MHz. Yet this advantage is attainable without increasing the overall antenna size due to the use of meanderline conductors for connecting the feed and ground terminals 88 and 90 on the radiating element 79 to the feed and ground terminals 80 and 82 on the printed circuit board 56.

Figure 10A:
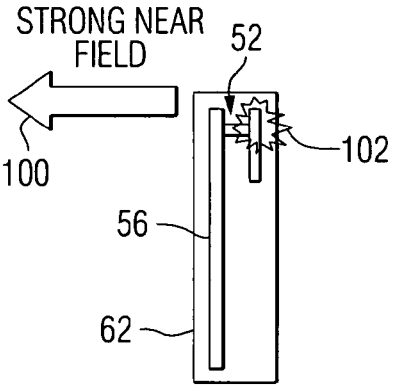
FIGS. 10A and 10B illustrate the affect of an antenna constructed according to the teachings of the present invention on the specific absorption ratio.
Figure 10B:
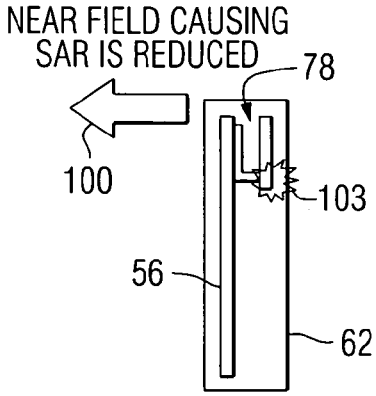

It has also been determined that there is a beneficial reduction in the specific absorption ratio (or SAR, a measure of the amount of radiation to which the user of a cellular telephone is subjected when the telephone is in the operational position near the user's head) when the connections of the feed and ground terminals to the radiating element 10 are as illustrated in the various embodiments described above. This effect is illustrated in FIGS. 10A and 10B, (the upper folder 64 is not shown for clarity) where the magnitude of the antenna near-field electromagnetic radiation is indicated by the length of an arrowhead 100 and a region of maximum surface current is indicated by reference characters 102 and 103. The surface current maximum occurs in the region 102 (FIG. 10A) when the feed and ground terminals are as illustrated in FIGS. 3 and 4. Note the near-field radiation reduction illustrated in FIG. 10B, where the surface current maximum 103 occurs at the feed and ground terminals 88 and 90 on the radiating element 10, as illustrated in FIG. 5.

The "hand" or "body" effect is a known phenomenon that should be considered in the design of antennas for handheld communications devices. Although an antenna incorporated into such devices is designed and constructed to provide certain ideal performance characteristics, in fact all of the performance characteristics are influenced, some significantly, by the proximity of the user's hand or body to the antenna when the communications device is in use. When the hand of a person or another grounded object is placed close to the antenna, stray capacitances are formed between the effectively grounded object and the antenna. These capacitances can significantly detune the antenna, shifting the antenna resonant frequency (typically to a lower frequency) and can thereby reduce the received or transmitted signal strength. It is impossible to accurately predict and design the antenna to completely ameliorate these effects, as each user handles and holds the handset communications device differently.

Figure 11A:
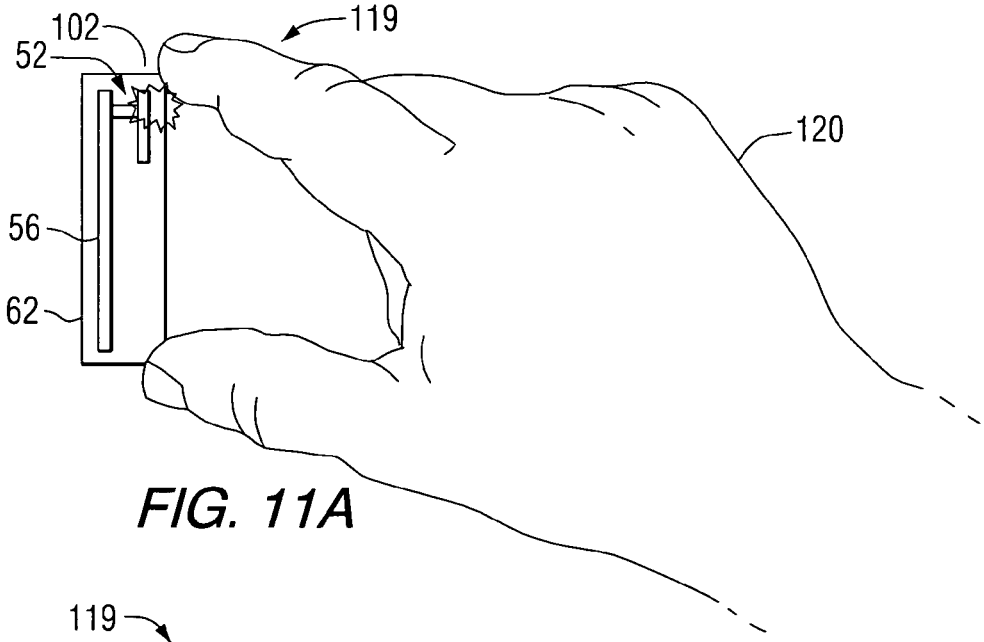
FIGS. 11A and 11B illustrate the affect of an antenna constructed according to the teachings of the present invention on the hand effect phenomenon.
Figure 11B:
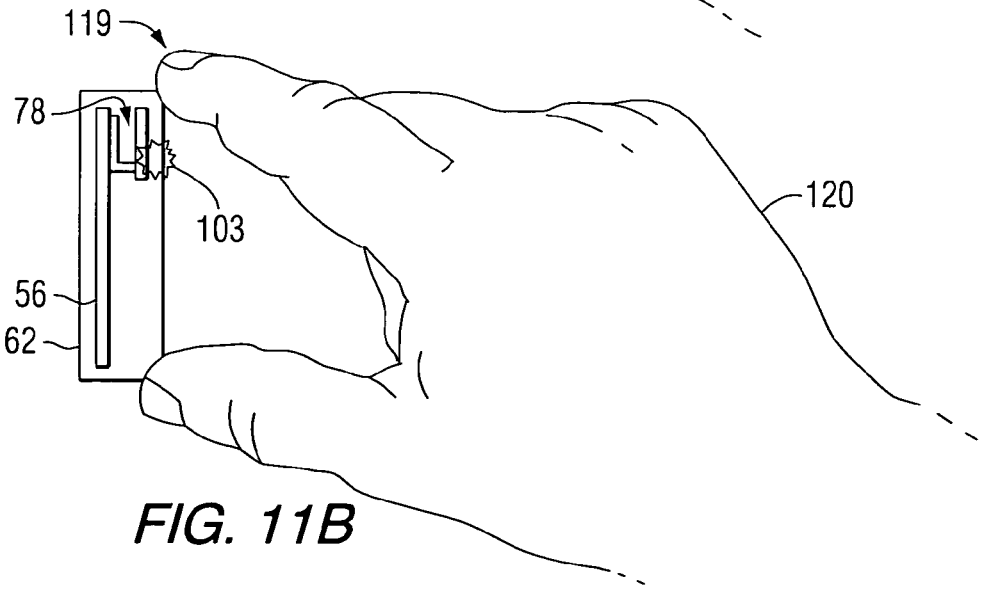

According to the teachings of the present invention, the hand effect is reduced due to the location of the feed and ground terminals 88 and 90 on the radiating element 79 as illustrated in FIG. 5. As illustrated in FIG. 11A, a finger 119 of a user's hand 120, when holding the handset 50 in the operational mode, is proximate the surface current maximum region 102. For an antenna constructed according to the teachings of the present invention, i.e., as illustrated in FIG. 5, the surface current maximum occurs in the region 103 and the hand effect and the frequency detuning caused thereby is reduced. See FIG. 11B.

An antenna has been described as useful in a communications handset device. Specific applications and exemplary embodiments of the invention have been illustrated and discussed that provide a basis for practicing the invention in a variety of ways and in a variety of circuit structures. Numerous variations are possible within the scope of the invention. Features and elements associated with one or more of the described embodiments are not to be construed as required elements for all embodiments. The invention is limited only by the claims that follow.

What is claimed is:

1. A communications device operative to transmit and receive communications signals, comprising first and second enclosures coupled by a pivotable joint joining the first and the second enclosures along an edge of each of the first and the second enclosures, wherein the first and the second enclosures comprise respective first and second surfaces, and wherein the communications device is in a closed state when the first and the second surfaces are disposed in a proximate facing relation, and wherein the communications device is in a open state when the first and the second surfaces are disposed in a spaced apart relation by pivoting of the first and the second enclosures with respect to the pivotable joint, the communications device comprising:

within the first enclosure;

a radio frequency signal radiating element comprising a first feed terminal and a first ground terminal;

a first substrate spaced apart from the radiating element and comprising a ground plane having a second ground terminal, the substrate further comprising a second feed terminal;

a first conductive element connected between the first and the second feed terminals;

a second conductive element connected between the first and the second ground terminals;

within the second enclosure;

a second ground plane;

wherein at least one of the first feed terminal and the first ground terminal are positioned on the radiating element to minimize coupling between the radiating element and the second ground plane when the communications device is the open state.

2. The communications device of claim 1 wherein the first and the second conductive elements comprise a first and a second meanderline conductor, respectively.

3. The communications device of claim 2 wherein the first and the second meanderline conductors are disposed on a dielectric substrate.

4. The communications device of claim 1 wherein the signal radiating element and the first ground plane are in a spaced apart relation with an air gap therebetween, and wherein a segment of the first conductive element and a segment of the second conductive element are disposed within the air gap.

5. The communications device of claim 1 wherein the first and the second conductive elements are disposed in a spaced apart relation from the first ground plane and form an air gap between the first conductive element and the ground plane, and an air gap between the second conductive element and the ground plane.

6. The communications device of claim 1 wherein the first feed terminal is positioned on the radiating element to substantially maximize a distance between the first feed terminal and the second ground plane when the communications device is in the open state.

7. The communications device of claim 1 wherein the first enclosure comprises a lower folder and the second enclosure comprises an upper folder of a folder type cellular telephone.

8. The communications device of claim 1 wherein the first conductive element is dimensioned to substantially match the impedances of the first and the second feed terminals, and wherein the second conductive element is dimensioned to substantially match the impedances of the first and the second ground terminals.

9. The communications device of claim 1 wherein the first conductive element is shorter than $\lambda/8$, where $\lambda$ represents the wavelength of the signal carried on the first conductive element.

10. The communications device of claim 1 wherein the second feed terminal is disposed between the first feed terminal and the second ground plane when the communications device is in the open state.

11. The communications device of claim 1 wherein the second feed terminal is disposed proximate the pivotable joint, and wherein the first feed terminal is disposed at a greater distance from the pivotable joint than the second feed terminal.

12. The communications device of claim 11 wherein the radiating element is disposed overlying the first substrate with a dielectric material disposed therebetween, and wherein the first conductive element is disposed proximate the dielectric material.

13. A communications device operative to transmit and receive communications signals, comprising first and second enclosures coupled by a pivotable joint joining the first and the second enclosures along an edge of each of the first and the second enclosures, wherein the first and the second enclosures comprise respective first and second surfaces, and wherein the communications device is in a closed state when the first and the second surfaces are disposed in a proximate facing relation, and wherein the communications device is in a open state when the first and the second surfaces are disposed in a spaced apart relation by pivoting of the first and the second enclosures with respect to the pivotable joint, the communications device comprising:

within the first enclosure;

a radio frequency signal radiating element comprising a first feed terminal and a first ground terminal;

a first substrate spaced apart from the radiating element and comprising a ground plane having a second ground terminal, the substrate further comprising a second feed terminal;

a first meanderline conductor connecting the first and the second feed terminals;

a second meanderline conductor connecting the first and the second ground terminals; and within the second enclosure;

a second ground plane.

14. The communications device of claim 13 further comprising a dielectric substrate underlying at least one of the first and the second meanderline conductors.

15. The communications device of claim 13 further comprising a dielectric substrate, wherein at least one of the first and the second meanderline conductors is disposed proximate the dielectric substrate.

16. The communications device of claim 15 further comprising a dielectric substrate, wherein at least one of the first and the second meanderline conductors is disposed within the dielectric substrate.

17. The communications device of claim 13 wherein a region of relatively high current is located proximate the first feed terminal, and wherein the region of relatively high current is located to reduce the specific absorption ratio for a user of the communications device.

18. The communications device of claim 13 wherein a region of relatively high current is located proximate the first feed terminal, and wherein the region of relatively high current is located to reduce the hand effect for a user of the communications device.

* * * * *